United States Patent [19]

Bolduc

[11] 4,334,482

[45] Jun. 15, 1982

[54] TABLE WITH ELEVATOR TYPE LAZY SUSAN

[76] Inventor: Leo J. Bolduc, 45 NW. Irving, Bend, Oreg. 97701

[21] Appl. No.: 151,884

[22] Filed: May 20, 1980

[51] Int. Cl.[3] ..... A47B 57/00

[52] U.S. Cl. ..... 108/95; 108/94; 108/96

[58] Field of Search ..... 108/94, 95, 96

[56] References Cited

U.S. PATENT DOCUMENTS

| | | | |
|---|---|---|---|
| 48,888 | 7/1865 | Atwater | 108/96 |
| 500,839 | 7/1893 | Anthony | 108/94 |
| 1,221,646 | 4/1917 | Zimmermann | 108/96 |
| 1,790,338 | 1/1931 | Chartoff | 108/94 |
| 1,893,551 | 1/1933 | Kask | 108/96 X |
| 2,079,225 | 5/1937 | Sabaneeff | 108/96 X |
| 3,118,398 | 1/1964 | Mays | 108/94 X |
| 4,119,834 | 10/1978 | Losch | 108/94 X |

FOREIGN PATENT DOCUMENTS

| | | | |
|---|---|---|---|
| 1561152 | 3/1969 | France | 108/96 |

*Primary Examiner*—Roy D. Frazier
*Assistant Examiner*—Peter A. Aschenbrenner
*Attorney, Agent, or Firm*—Harvey B. Jacobson

[57] ABSTRACT

A table including a top and depending legs anchored relative to the top for support of the latter in elevated position about a floor surface upon which the lower end of the legs rest. The top includes a central vertical opening therein and a pair of upper and lower vertically spaced panels are provided with an upright extending between and interconnecting the panels and supported from the table for vertical shifting relative thereto between a lowered position with the upper panel at least closely overlying the top opening and an upper position with the lower panel received within the opening.

3 Claims, 4 Drawing Figures

TABLE WITH ELEVATOR TYPE LAZY SUSAN

BACKGROUND OF THE INVENTION

Although various forms of lazy susan structures have been provided for use in conjunction with tables at which meals are eaten, most of these lazy susan structures are constructed as portable devices and must be placed upon and removed from an associated meal table. Further, some forms of tables include lazy susan-type raised central shelves supported therefrom, but these latter forms of lazy susan structures prevent the associated table from being utilized for different purposes at times other than mealtimes.

Accordingly, a need exists for a table equipped with a lazy susan structure retractably supported therefrom, whereby the table may be equipped with a lazy susan when it is being utilized at mealtimes and the lazy susan structure may be at least substantially retracted when its presence is not required to thereby enable the table to be utilized for other purposes.

Examples of various forms of lazy susan structures including some of the general structural and operational features of the instant invention are disclosed in U.S. Pat. Nos. 3,139,189 and 3,227,283 as well as U.S. Pat. No. Des. 237,236, 163,025, 176,099 and 195,072.

BRIEF DESCRIPTION OF THE INVENTION

The lazy susan structure of the instant invention is incorporated into a conventional form of table which may be utilized for eating purposes and the lazy susan structure is retractable relative to the top of the table. When the lazy susan is in the extended position, two vertically spaced and rotatable shelves or support structures are provided for support and rotation about a center axis. When the lazy susan is in the retracted position, the upper shelf or support structure thereof is retracted downwardly in overlying relation relative to the adjacent central surfaces of the associated table top.

The main object of this invention is to provide a table equipped with a lazy susan structure incorporated therein and yet whose structural features enable the lazy susan structure to be substantially fully retracted relative to the tabletop to thereby enable the table top to be utilized for different purposes.

Still another object of this invention is to provide a lazy susan structure which, when in the retracted position, may continue to support various condiments and the like from a lower shelf portion thereof recessed downwardly below the associated table top.

Another important object of this invention is to provide a lazy susan construction which, when in the operative position, will provide a pair of vertically spaced support surfaces or shelves upon which to support condiments and serving dishes of food.

A still further object of this invention is to provide a table having a lazy susan structure incorporated therein independent of the basic table structure and which may therefore be incorporated in substantially any form of conventional table construction independent of major modifications of the tabletop supporting structure.

A final object of this invention to be specifically enumerated herein is to provide a table equipped with an elevator-type lazy susan and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates a table construction including a tabletop 12 and depending legs 14 for support of the tabletop 12 from a suitable floor surface 16.

The legs 14 may be supported from the tabletop 12 in any convenient manner and be braced relative thereto as desired. The tabletop 12 is preferably round in plan shape, but the tabletop 12 may be of other plan shapes such as square, rectangular, oval, etc.

Figure 1:
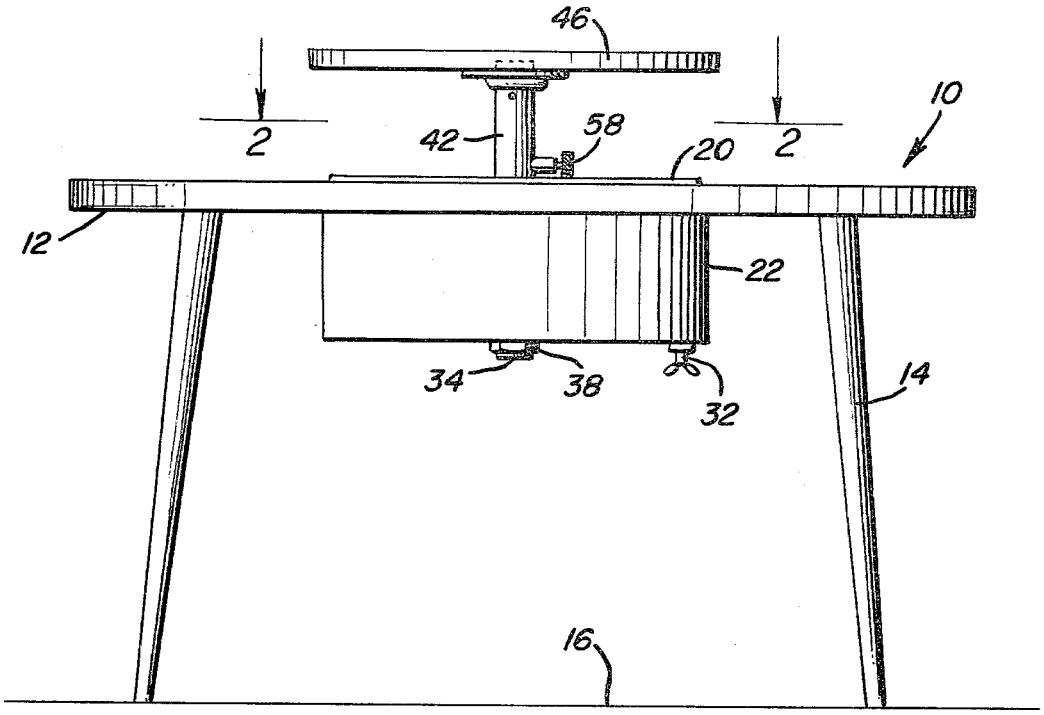
FIG. 1 is a side elevational view of a convention form of table incorporating the retractable lazy susan structure therein.
Figure 2:
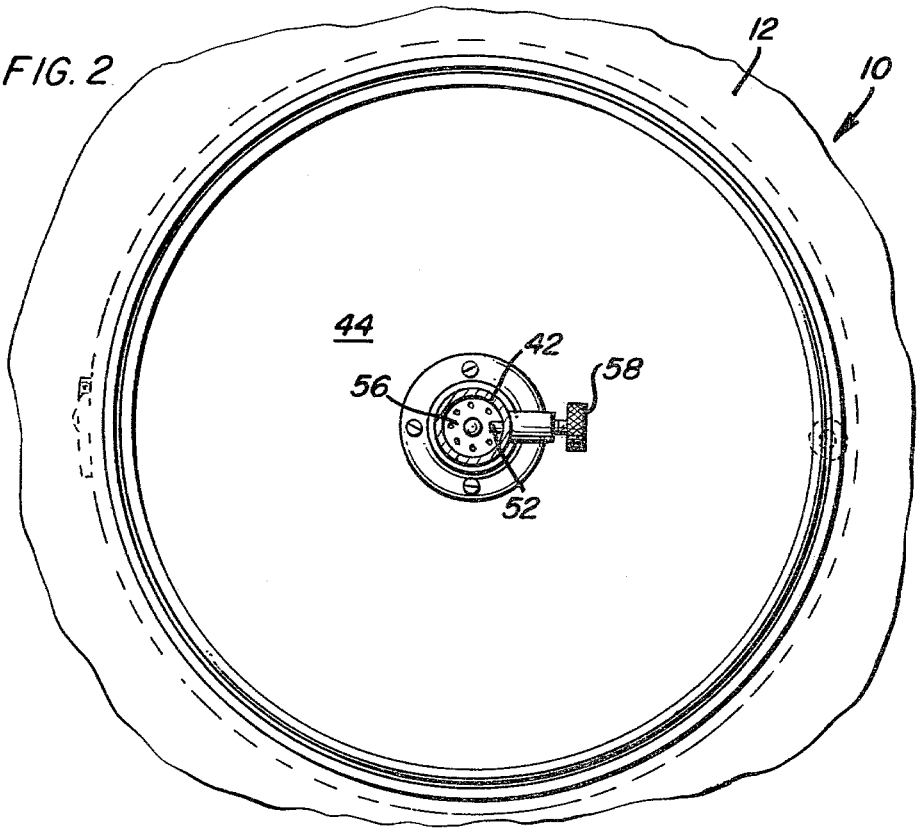
FIG. 2 is an enlarged fragmentary horizontal sectional view taken substantially upon the plane indicated by the section line 2—2 of FIG. 1.
Figure 3:
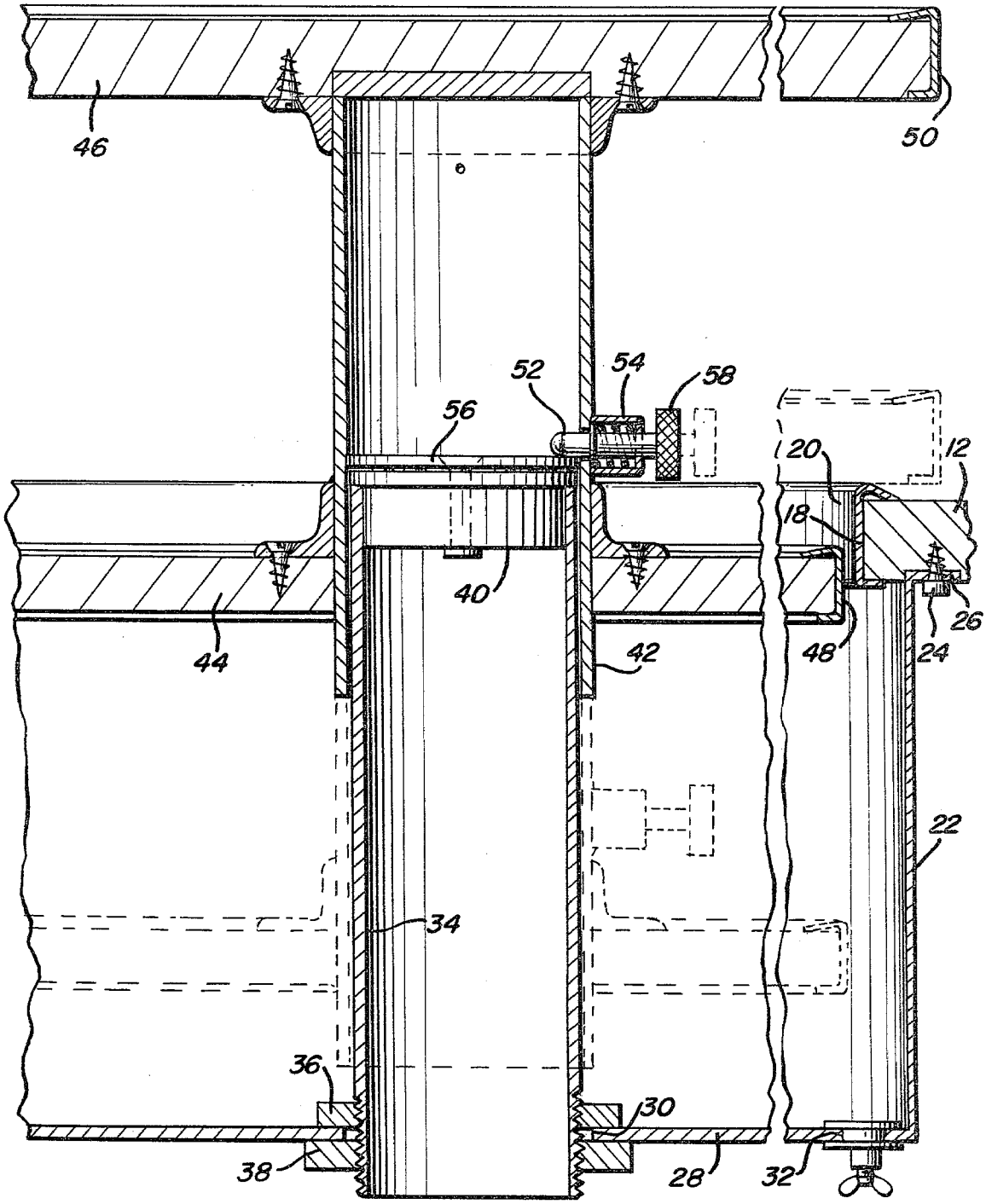
FIG. 3 is a fragmentary enlarged vertical sectional view taken substantially upon a plane passing through the central portion of the table and lazy susan structure.

It may be noted more clearly from FIG. 3 of the drawings that the tabletop 12 has a central round opening 18 formed therein with which a peripherally extending trim ring 20 is operatively associated. An upwardly opening hollow housing 22 is supported from the underside of the tabletop 12 through the utilization of suitable fasteners 24 secured through a mounting flange 26 extending about the open upper end of the housing 12 and upwardly recessed into the undersurface of the tabletop 12. The housing 22 includes a bottom wall 28 having a central opening 30 formed therein and the bottom wall 28 additionally includes a pet cock equipped drain outlet fitting 32.

An upright support tube 34 has its lower end secured through the opening 30 in the bottom wall 28 by nuts 36 and 38 threaded on the lower end of the upright support tube 34 and clampingly engaging the bottom wall 28 therebetween. The upper end of the support tube 34 has a thrust bearing assembly 40 supported therefrom and an upstanding tubular shank 42 has its lower end removably telescoped downwardly over the upper end of the support tube 34. The tubular shank 42 supports a circular lower panel 44 from its lower end portion with the lower panel 44 concentric with the shank 42 and a slightly larger diameter circular upper panel 46 is supported from the upper end of the tubular shank 42. The lower and upper panels 44 and 46 include outer peripheral trim rings 48 and 50 and the lower panel 44 is slightly smaller in diameter than the opening 18 so that it may be downwardly received through the opening 18. On the other hand, the upper panel 46 is slightly larger in diameter than the opening 18 in order that lowering of the upper panel 46 downwardly toward the opening 18 will cause the undersurface of the outer periphery of the upper panel 46 to contact and be supported by the trim ring 20 extending about the opening 18 and projecting slightly upwardly beyond the upper surface of the tabletop 12.

The tubular shank 42 includes a radially shiftable and spring biased detent 52 supported therefrom. The detent 52 is extendable inwardly under the biasing action of a spring 54 to a position projecting inwardly of the inner surface of the tubular shank 42 for abutting engagement with the upper portion 56 of the thrust bearing assembly 40. The detent 52 may be radially retracted outwardly of the inner surface of the tubular shank 42 by manually gripping and outwardly pulling on the knob 58 carried by the outer end of the radially extending detent 52. When the detent 52 is retracted outwardly to the phantom line position thereof illustrated in FIG. 3 of the drawings, the tubular shank 42 may be slid downwardly relative to the upstanding tube 42 to the lower phantom line position thereof illustrated in FIG. 3. In this position, the upper panel 46 abuts and overlies the trim ring 20 and the lower panel 44 is fully downwardly retracted within the housing 42. However, when it is desired to raise the lazy susan structure comprising the panels 44, 46 and the tubular shank 42, the upper panel 46 is gripped and upwardly displaced to the solid line position thereof illustrated in FIG. 3. When the tubular shank 42 is in its uppermost position, the radial detent 52 is automatically biased inwardly by the spring 54 for abutting the upper portion 56 of the thrust bearing assembly 40 to thereby releasably support the lazy susan structure in the raised operative position.

Condiments and the like may be conventionally supported from the lower panel 44 and food serving dishes may be supported from the upper panel 46. When the table 10 is not being utilized for eating purposes, the lazy susan structure may be downwardly retracted to the phantom line position thereof illustrated in FIG. 3 whereupon all of the condiments supported on the lower panel 44 will be fully downwardly recessed within the housing 22. In this mode, the table may be used for purposes other than eating, such as playing cards. However, when it is desired to utilize the table for eating purposes, the lazy susan structure is upwardly extended to the phantom line position thereof illustrated in FIG. 3 and the various condiments supported on the lower panel 44 are automatically raised into position for ready access by the persons seated at the table. Also, serving dishes of prepared food may be conveniently supported on the upper panel 46.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A table including a top and depending leg means anchored relative to the top for support of the latter in elevated position above a flooring surface, said top including a central vertical opening therein, a pair of upper and lower vertically spaced panels, means extending between and interconnecting said panels and supported from said table for rotation about a vertical axis passing centrally through said opening and free vertical shifting relative to said table along said axis between a lowered position with said upper panel at least substantially downwardly toward said top and said lower panel downwardly retracted below said opening and an upper position with said upper panel appreciably spaced above said opening and said lower panel extended upwardly into and rotatably received in said opening, said panels being of substantially the same plan shape, said opening being of substantially the same plan shape but slightly larger than said lower panel, said table including an upwardly opening housing supported from the underside of the top thereof in vertical registry with said opening, said lower panel being downwardly receivable within said housing when said upper and lower panels are in their lower positions, said housing including a bottom wall, an upstanding support mounted on said bottom wall and projecting upwardly toward said table top, said means extending between and interconnecting said panels including a tubular member telescopingly engaged with said upstanding support, the upper end of said upstanding support including a thrust bearing assembly, said tubular member including a radially outwardly retractable inwardly projecting abutment downwardly abuttingly engaged with an upper portion of said thrust bearing assembly.

2. A table including a top and depending leg means anchored relative to the top for support of the latter in elevated position above a floor surface, said top including a central vertical opening therein, a pair of upper and lower vertically spaced panels, means extending between and interconnecting said panels and supported from said table for vertical shifting relative thereto between a lowered position with said upper panel at least substantially downwardly retracted toward said top and said lower panel downwardly retracted below said opening and an upper position with said upper panel appreciably spaced above said opening and said lower panel extended upwardly into said opening, said panels being of substantially the same plan shape, said opening being of substantially the same plan shape but of slightly larger area than said lower panel, said upper panel being of slightly larger diameter than said opening, said table including an upwardly opening housing supported from the underside of the top thereof in vertical registry with said opening, said lower panel being downwardly receivable within said housing when said upper and lower panels are in their lower positions, said housing including a bottom wall, an upstanding support mounted on said bottom wall and projecting upwardly toward said tabletop, said means extending between and interconnecting said panels including a tubular member telescopingly engaged with said upstanding support, the upper end of said upstanding support including a thrust bearing assembly, said tubular member including a radially outwardly retractable inwardly projecting abutment downwardly abuttingly engaged with an upper portion of said thrust bearing assembly.

3. A table including a top and depending leg means anchored relative to the top for support of the latter in elevated position above a flooring surface, said top including a central vertical opening therein, a pair of upper and lower vertically spaced panels, means extending between and interconnecting said panels and supported from said table for rotation about a vertical axis passing centrally through said opening and free vertical shifting relative to said table along said axis between a lowered position with said upper panel at least substantially downwardly retracted toward said top and said lower panel downwardly retracted below said opening and an upper position with said upper panel appreciably spaced above said opening and said lower panel extending upwardly into and rotatably received in said opening, said table including a stationary upright supported therefrom and projecting upwardly into the central portion of said opening, said means extending between and interconnecting said panels including a tubular member telescopingly and rotatably engaged with said upstanding support, the upper end of said upstanding support including a thrust bearing assembly, said tubular member including a radially outwardly retractable inwardly projecting abutment downwardly abuttingly engaged with an upper portion of said thrust bearing assembly.

* * * * *